US011247830B2

(12) United States Patent
Uchida

(10) Patent No.: US 11,247,830 B2
(45) Date of Patent: Feb. 15, 2022

(54) CONTAINER AND PROTECTION MEMBER

(71) Applicant: SHARP KABUSHIKI KAISHA, Sakai (JP)

(72) Inventor: Takashi Uchida, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 17/185,151

(22) Filed: Feb. 25, 2021

(65) Prior Publication Data

US 2021/0269218 A1 Sep. 2, 2021

(30) Foreign Application Priority Data

Mar. 2, 2020 (JP) ..... JP2020-035155

(51) Int. Cl.
*B65D 81/05* (2006.01)
*B65D 85/48* (2006.01)

(52) U.S. Cl.
CPC ..... *B65D 81/053* (2013.01); *B65D 85/48* (2013.01); *B65D 2581/055* (2013.01); *B65D 2585/6837* (2013.01)

(58) Field of Classification Search
CPC ..... B65D 81/053; B65D 85/48; B65D 2581/055; B65D 2585/6837; B65D 81/113
See application file for complete search history.

(56) References Cited

U.S. PATENT DOCUMENTS

| | | | | |
|---|---|---|---|---|
| 9,758,298 | B2 * | 9/2017 | Cheng | B65D 81/053 |
| 2014/0097121 | A1 * | 4/2014 | Chen | B65D 85/48 206/586 |
| 2019/0300261 | A1 * | 10/2019 | Nakamichi | B65D 85/30 |
| 2020/0122913 | A1 * | 4/2020 | Sim | B65D 85/30 |
| 2020/0172315 | A1 * | 6/2020 | Hu | B65D 81/113 |
| 2020/0198867 | A1 * | 6/2020 | Nakamichi | B65D 81/056 |
| 2020/0277122 | A1 | 9/2020 | Uchida | |
| 2020/0331673 | A1 * | 10/2020 | Wu | B65D 81/266 |

FOREIGN PATENT DOCUMENTS

| | | | |
|---|---|---|---|
| JP | 2014-009020 | A | 1/2014 |
| JP | 2017-178380 | A | 10/2017 |
| WO | 2019/049311 | A1 | 3/2019 |

* cited by examiner

*Primary Examiner* — Jacob K Ackun
(74) *Attorney, Agent, or Firm* — ScienBiziP, P.C.

(57) ABSTRACT

A bottom surface member of a container defines an xy plane, and a side surface member defines an xz plane and a yz plane. A protection member includes a receiving portion having a receiving surface parallel to the xz plane and a support portion integrally formed with the receiving portion. The receiving portion includes a first flat plate portion that includes the receiving surface and is parallel to the xz plane. The support portion includes a contact portion that is in contact with a side surface of the side surface member and a second flat plate portion parallel to the yz plane.

13 Claims, 9 Drawing Sheets

PRIOR ART

CONTAINER AND PROTECTION MEMBER

BACKGROUND

1. Technical Field

The present invention relates a container, for example, a container preferably usable to transport an object accommodated therein, and a protection member usable for the container.

2. Description of the Related Art

For example, Japanese Laid-Open Patent Publication No. 2014-9020 and WO2019/049311 each disclose a packaging member (i.e., container) usable to transport a display panel. The container disclosed in Japanese Laid-Open Patent Publication No. 2014-9020 includes a corner protection member provided at a corner of a recessed portion that accommodates the display panel. The corner protection member is detachably fittable to a main body of the container and protects a corner of the display panel, which is an object to be accommodated. According to Japanese Laid-Open Patent Publication No. 2014-9020 and WO2019/049311, use of the corner protection member allows a common container main body and a common lid to be used regardless of whether a display panel having a circuit board connected therewith (hereinafter, may be referred to as a "display panel module") is to be accommodated or only a display panel is to be accommodated.

SUMMARY

However, in the case where the container described in Japanese Laid-Open Patent Publication No. 2014-9020 is used, when, for example, a large acceleration is applied during the transportation of the display panel, a corner of the display panel is occasionally cracked. According to the studies made by the present inventor, this problem is caused because when a large acceleration (force) is applied to the corner protection member, the corner protection member rotates, as described below.

In the case where the container described in WO2019/049311 is used, the above-mentioned rotation is prevented and thus the display panel may be prevented from being cracked. However, the container is occasionally cracked due to the load applied to the corner protection member, which is caused by collision of the display panel during the transportation. Such a crack of the container causes the corner protection member to be shifted easily. As a result, the display panel may possibly be cracked or chipped away at a corner thereof.

In the above, the container accommodating a display panel is described. However, this problem is not limited to occurring in the case where the container accommodates a display panel, but may occur in the case where the container accommodates a rectangular plate-like object formed of a material that is easily cracked or chipped away (e.g., a glass plate or a plastic plate).

One non-limiting, and exemplary embodiment provides a technique to provide a container and a protection member capable of, when a large acceleration is applied to an accommodated object, suppressing a corner of the accommodated object from being cracked or chipped away.

A container according to an embodiment of the present invention comprises an accommodation member two protection members. The accommodation member includes a bottom surface member defining a bottom surface of an accommodation space having four corners and also includes a side surface member defining side surfaces of the accommodation space. The bottom surface member defines an xy plane, and the side surface member defines an xz plane and a yz plane both perpendicular to the xy plane. The two protection members are located at two corners adjacent to each other among the four corners of the accommodation space. The side surface member includes a first side surface member extending in an x direction and a second side surface member extending in a y direction, and a protruding portion protruding in the x direction from the second side surface member is formed at each of the two corners. Each of the two protection members includes a receiving portion having a receiving surface that is in contact with an object to be accommodated in the accommodation space and includes a support portion integrally formed with the receiving portion. The receiving portion includes a first flat plate portion parallel to the xz plane. The support portion includes a contact portion having a side surface that is in contact with a side surface, of the first side surface member, that is directed toward the accommodation space and includes a second flat plate portion coupling the first flat plate portion and the contact portion to each other, the second flat plate portion being parallel to the yz plane. A tip end of the first flat plate portion is fit into the second side surface member, and a rear surface of a contact region, of the receiving surface, that is to be in contact with the object is in contact with a side surface, of the protruding portion, that is parallel to the xz plane.

The protection member according to an embodiment of the present invention is usable for the container having any of the above-described features.

According to an embodiment of the present invention, it is possible to provide a container and a protection member capable of, when a large acceleration is applied to an accommodated object, suppressing a corner of the accommodated object from being cracked or chipped away.

DETAILED DESCRIPTION

Figure 9:
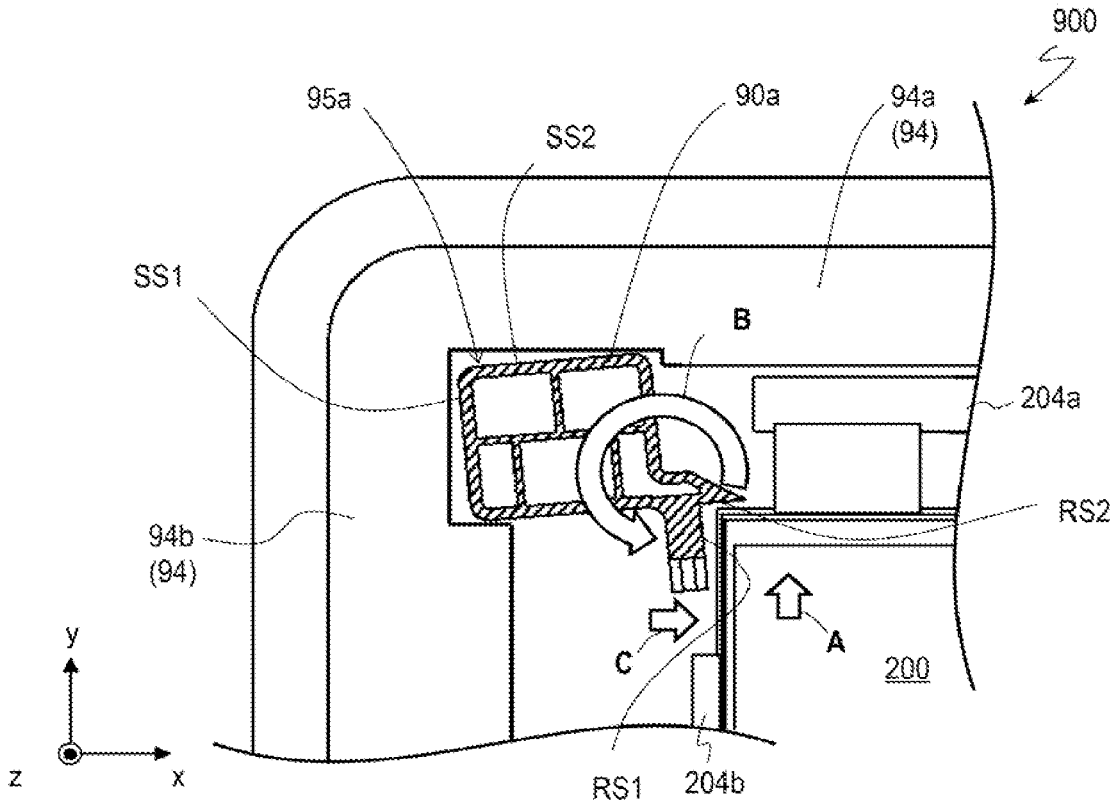
FIG. 9 is a schematic plan view of a container 900 in a comparative example and is provided to describe a problem caused by a protection member 90*a*.

First, with reference to FIG. 9, the above-described problem of the conventional container, including the corner protection member, described in Japanese Laid-Open Patent Publication No. 2014-9020 will be described. FIG. 9 is a schematic plan view of a container 900 including a protection member 90*a* having substantially the same structure as that of the corner protection member described in Japanese Laid-Open Patent Publication No. 2014-9020.

The container 900 includes the protection member 90*a* detachably located in a cutout portion 95*a* of a side surface member 94 (94*a*, 94*b*). The protection member 90*a* is integrally formed of a non-expanded resin. Two receiving surfaces RS1 and RS2 of the protection member 90*a* are in contact with a corner of a panel module 200, and thus the protection member 90*a* holds the panel module 200 such that the panel module 200 does not move in an xy plane. The receiving surface RS1 is parallel to a yz plane, whereas the receiving surface RS2 is parallel to an xz plane. The panel module 200 includes, for example, a source driver circuit board 204*a* and a gate driver 204*b*.

When, for example, an acceleration is applied to the panel module 200 in a y direction represented by arrow A as shown in FIG. 9, a force acts on the protection member 90*a* to rotate the protection member 90*a* counterclockwise as represented by arrow B. The protection member 90*a* is molded to have a high rigidity and therefore, rotates integrally (arrow B). The side surface member 94*a* of the container 900 is formed of an expanded resin, and the protection member 90*a* is formed of a material harder than that of the side surface member 94*a*. Therefore, the side surface member 94*a* may possibly be crushed by the protection member 90*a*. When the protection member 90*a* rotates, a portion of the protection member 90*a* that has the receiving surface RS2 collides against a side, of the panel module 200, along which the gate driver 204*b* is mounted (arrow C). This increases the frequency at which a glass substrate forming the display panel is cracked or chipped away.

A container according to an embodiment of the present invention solves the problem that when a large acceleration is applied to an accommodated object, a corner of the accommodated object is cracked or chipped away.

Hereinafter, a container according to an embodiment of the present invention will be described with reference to the drawings. In the following, a container that accommodates a liquid crystal display panel module will be described as an example. An embodiment of the present invention is not limited to the following example. It should be noted that an embodiment of the present invention is directed to a container preferably usable to accommodate an object, like a liquid crystal display panel module, that cannot be supported by four sides but needs to be supported at corners and is formed of a material that is easily cracked or chipped away (glass or a plastic material). An embodiment of the present invention is especially directed to a container preferably usable to transport a liquid crystal display panel module.

Figure 1A:
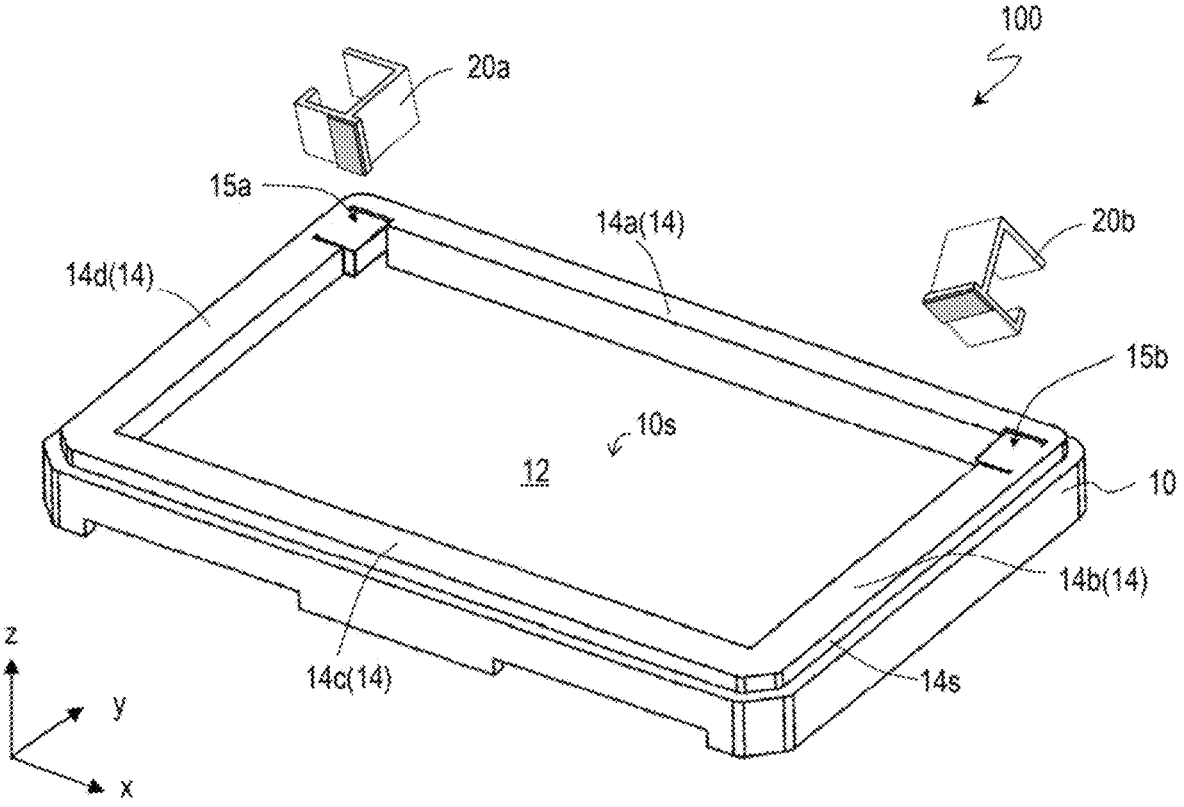
FIG. 1A is a schematic perspective view of a container 100 according to an embodiment of the present invention.
Figure 1B:
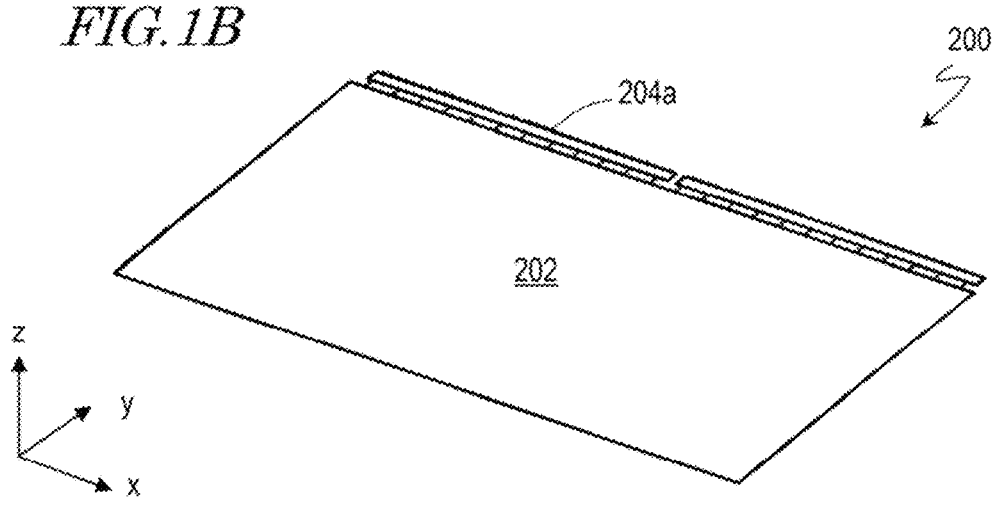
FIG. 1B is a schematic perspective view of a liquid crystal display panel module 200 to be accommodated in the container 100.

FIG. 1A is a schematic perspective view of a container 100 according to an embodiment of the present invention. FIG. 1B is a schematic perspective view of a liquid crystal display panel module (hereinafter, referred to as a "panel module") 200, which is to be accommodated in the container 100.

The container 100 includes an accommodation member including a bottom surface member 12 defining a bottom surface of an accommodation space 10*s* and a side surface member (14*a*, 14*b*, 14*c* and 14*d*) defining side surfaces of the accommodation space 10*s*, and also includes protection members 20*a* and 20*b* located in the accommodation space 10*s* and having receiving surfaces that are to be in contact with an object to be accommodated in the accommodation space 10*s*. The accommodation space 10*s* has four corners. The side surface member 14 includes two protruding portions 15*a* and 15*b* respectively facing two corners adjacent to each other among the four corners. The protruding portion 15*a* is located at a corner between a first side surface member 14*a* and a second side surface member 14*d* and protrudes toward the accommodation space 10*s* from the second side surface member 14*d*. The protruding portion 15*b* is located at a corner between the first side surface member 14*a* and a second side surface member 14*b* and protrudes toward the accommodation space 10*s* from the second side surface member 14*b*. Herein, the side surface member 14 includes the two protruding portions 15*a* and 15*b* facing each other while having, therebetween, a side of a liquid crystal display panel (hereinafter, referred to as a "panel") 202 of the panel module 200, the side being a side along which the source driver circuit board 204*a* is mounted. Needless to say, protruding portions may be provided so as to respectively face the four corners. The protection members 20*a* and 20*b* are respectively located at the corners so as to be fit into the protruding portions 15*a* and 15*b*. The bottom surface member 12 defines the xy plane, and the side surface member 14 defines the xz plane and the yz plane both perpendicular to the xy plane. Namely, the first side surface members 14*a* and 14*c* extend in an x direction, the second side surface members 14*b* and 14*d* extend in a y direction, and the protruding portions 15*a* and 15*b* protrude in the x direction.

The panel module 200 is located in the accommodation space 10*s* of the container 100. A plurality of (e.g., 10 to 20) panel modules 200 may be located in a stacked manner. In this case, a cushioning sheet (e.g., expanded polyethylene (EPE) sheet; thickness: for example, 1 mm) may be held between the panel modules 200. It is preferred that the cushioning sheet is smaller by several millimeters to about 10 mm than an outer shape of the panel 202.

Figure 2A:
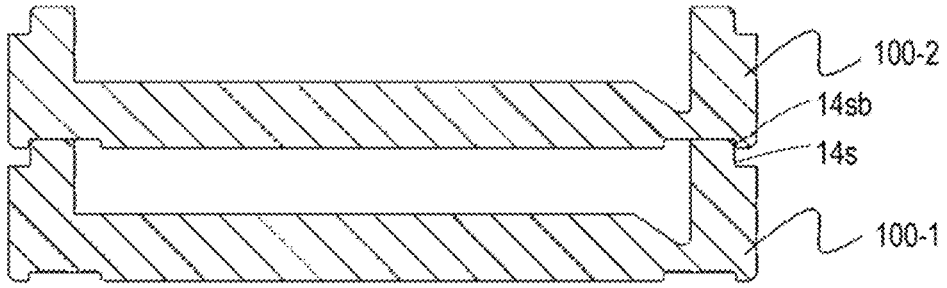
FIG. 2A is a schematic cross-sectional view showing a state in which a plurality of the containers 100 are stacked.
Figure 2B:
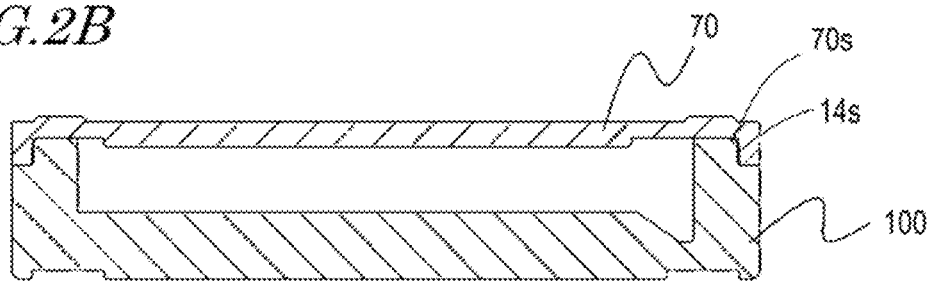
FIG. 2B is a schematic cross-sectional view showing a state in which a lid is located.

As shown in FIG. 2A, another container 100-2 may be stacked on a container 100-1 accommodating the panel module(s) 200. It is preferred that as shown here as an example, a bottom surface of the side surface member 14 of the container 100 has a stepped portion 14*sb* engageable with a stepped portion 14*s* provided at a top surface of the side surface member 14. The stepped portion 14*sb* may be formed as a part of a recessed portion. As shown in FIG. 2B, a lid 70 having a stepped portion 70*s* engageable with the stepped portion 14*s* provided at the top surface of the side surface member 14 may be prepared when necessary. The stepped portion 70*s* may be formed as a part of a recessed portion. The lid 70 may be formed of the same material as that of the accommodation member 10.

Figure 3:
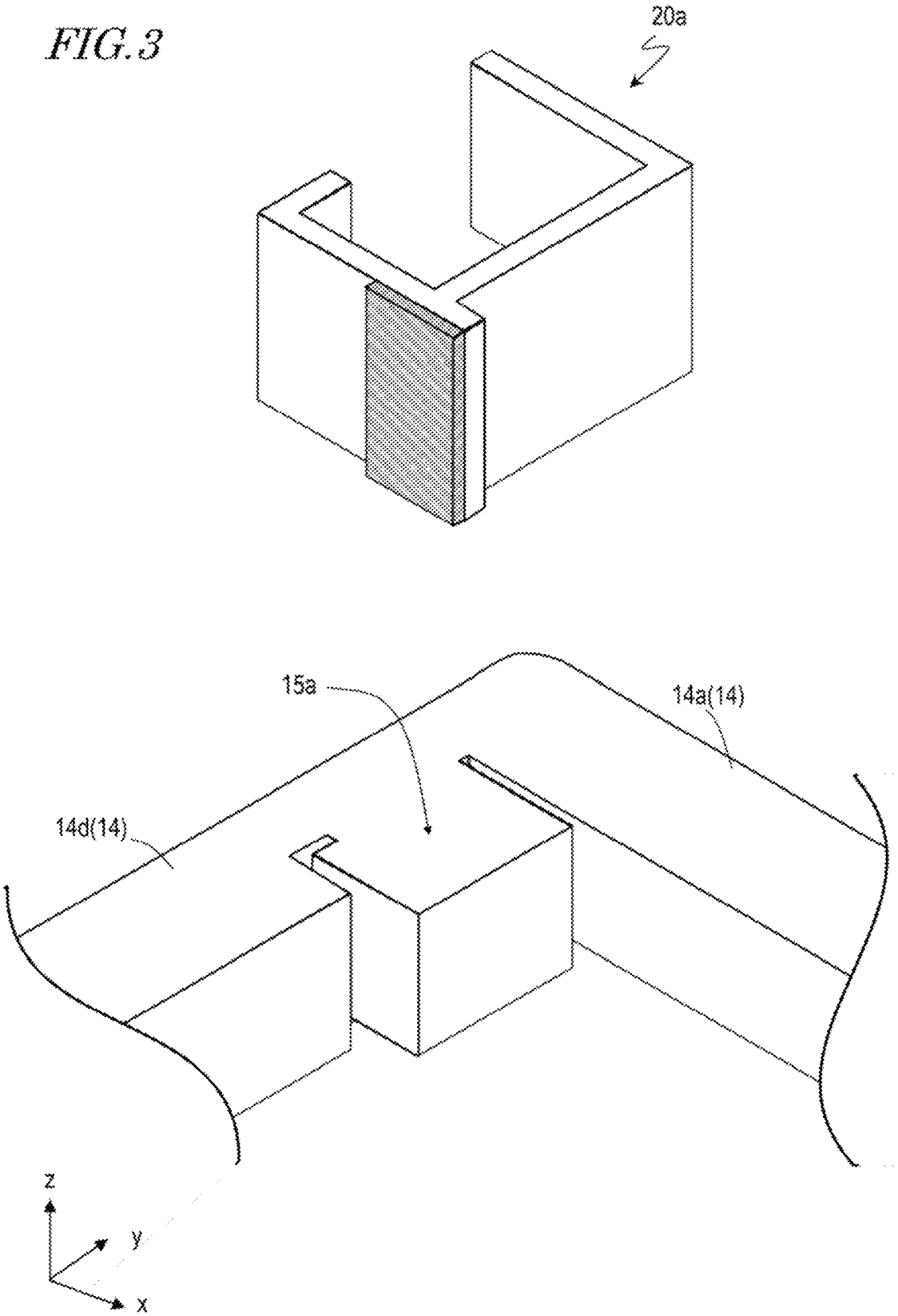
FIG. 3 is a schematic perspective view showing how a protection member 20*a* is attached to a protruding portion 15*a* of an accommodation member 10 of the container 100.
Figure 4:
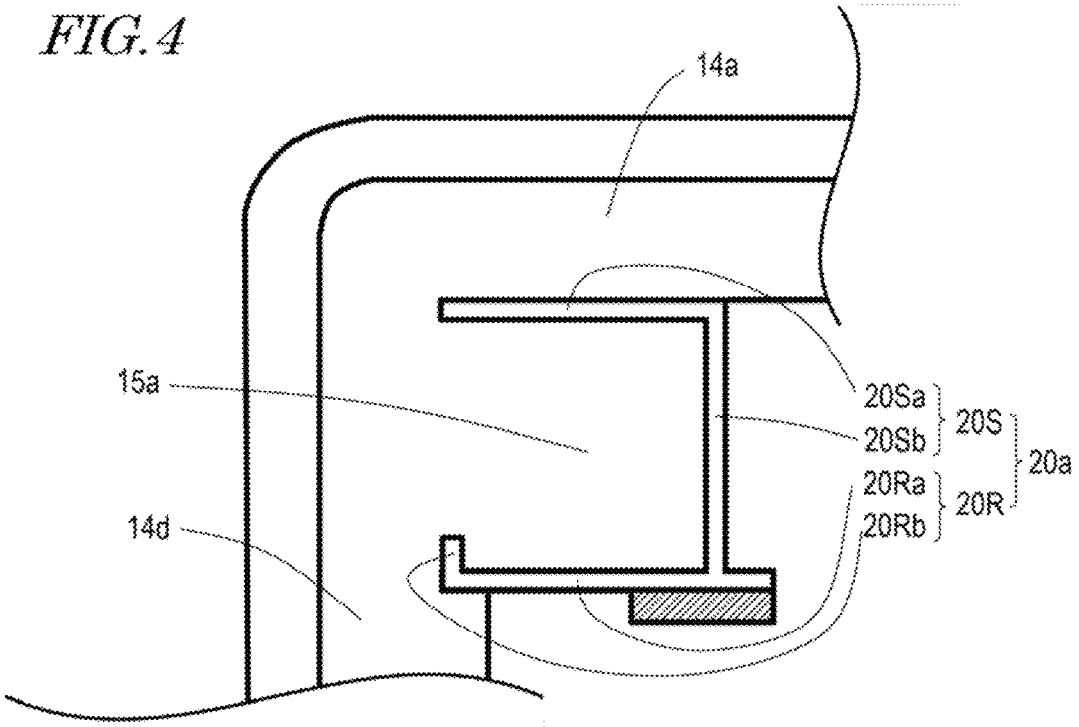
FIG. 4 is a schematic plan view showing a state in which the protection member 20*a* is attached to the protruding portion 15*a* of the accommodation member 10 of the container 100.

Now, FIG. 3 and FIG. 4 will be referred to. FIG. 3 is a schematic perspective view showing how the protection member 20*a* is attached to the protruding portion 15*a* of the accommodation member 10 of the container 100. FIG. 4 is a schematic plan view showing a state in which the protection member 20*a* is attached to the protruding portion 15*a* of the accommodation member 10 of the container 100. The protection member 20*b* to be attached to the protruding portion 15*b* has a shape symmetrical to that of the protection member 20*a* (the plane of symmetry is parallel to the yz plane). Thus, the protection member 20*a* will be described as an example, hereinafter.

The protection member 20*a* includes a receiving portion 20R having a receiving surface 24 to be in contact with the panel module 200 and a support portion 20S integrally formed with the receiving portion 20R.

The protection member 20*a* has side surfaces parallel to the xz plane and the yz plane. The protection member 20*a* is located at the corner such that the surfaces parallel to the xz plane and the yz plane are in contact with surfaces of the protruding portion 15*a* that are parallel to the xz plane and the yz plane.

When the protection member 20*a* is attached to the protruding portion 15*a*, inner surfaces of the protection member 20*a* contact surfaces of the protruding portion 15*a*. In this state, a force received by the protection member 20*a* from the panel module 200 is dispersed. As a result, the force of the protection member 20*a* that deforms the side surface member 14 is decreased, and thus the deformation of the side surface member 14 may be suppressed.

With reference to FIG. 5 through FIG. 8, the structure of the protection member 20*a* will be described in detail.

Figure 5A:
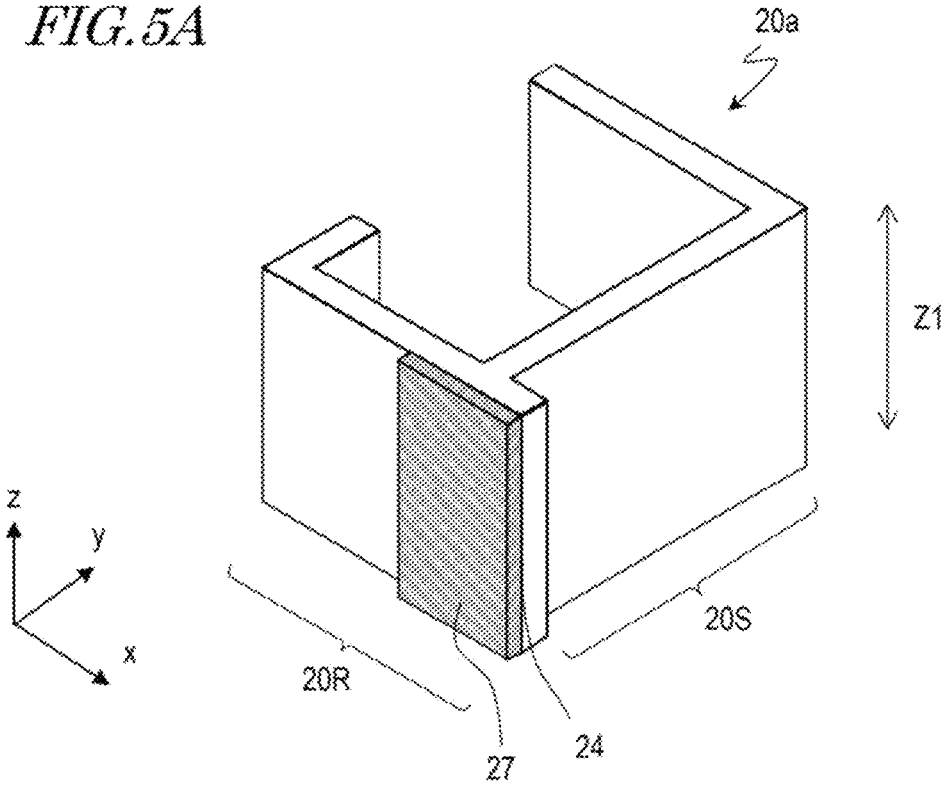
FIG. 5A is a schematic perspective view of the protection member 20*a* as seen from above.
Figure 5B:
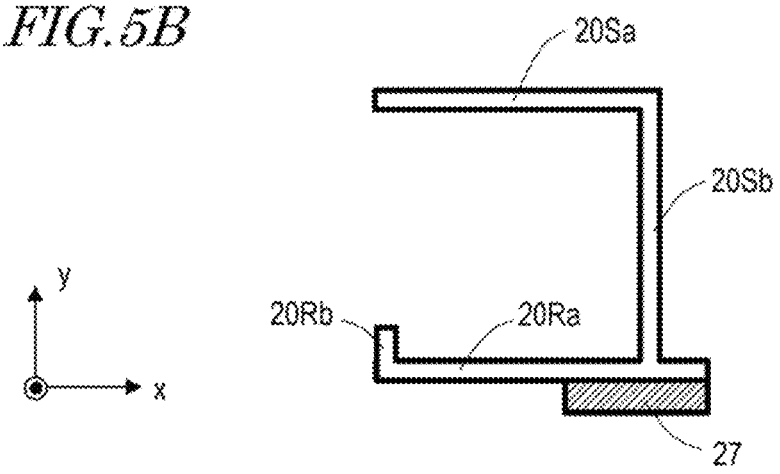
FIG. 5B is a schematic plan view of the protection member 20*a*.
Figure 6A:
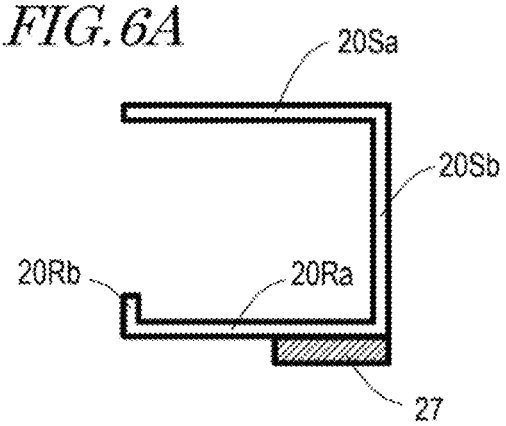
FIG. 6A, FIG. 6B, FIG. 6C and FIG. 6D are schematic plan views of protection members.
Figure 6B:
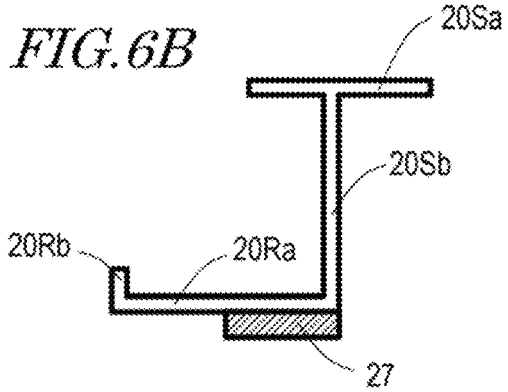
Figure 6C:
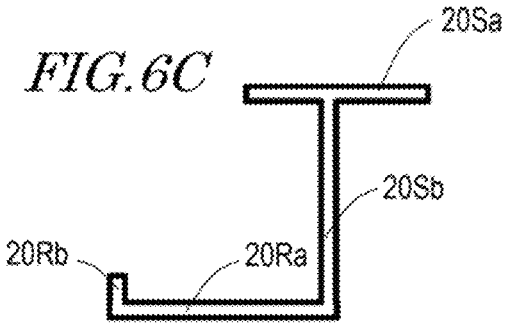
Figure 6D:
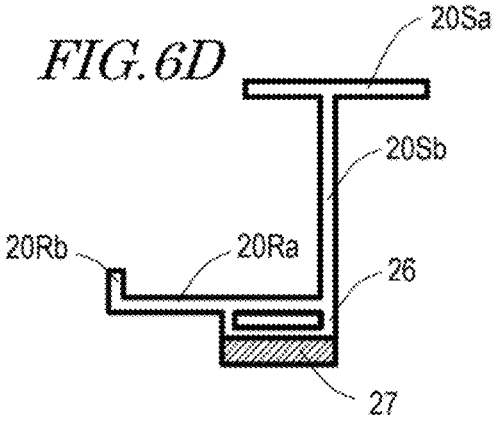
Figure 7A:
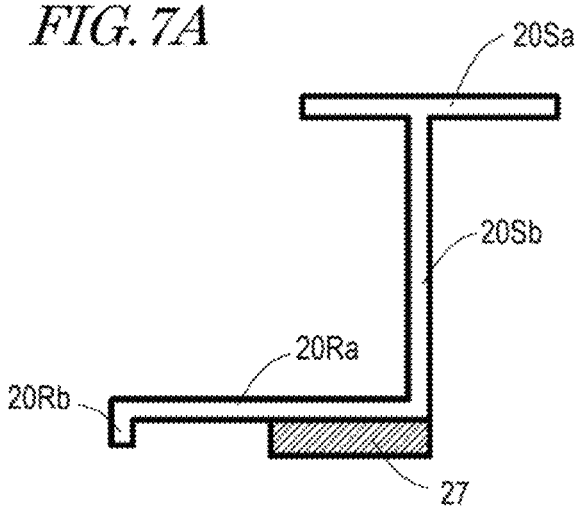
FIG. 7A, FIG. 7B and FIG. 7C are schematic plan views of protection members.
Figure 7B:
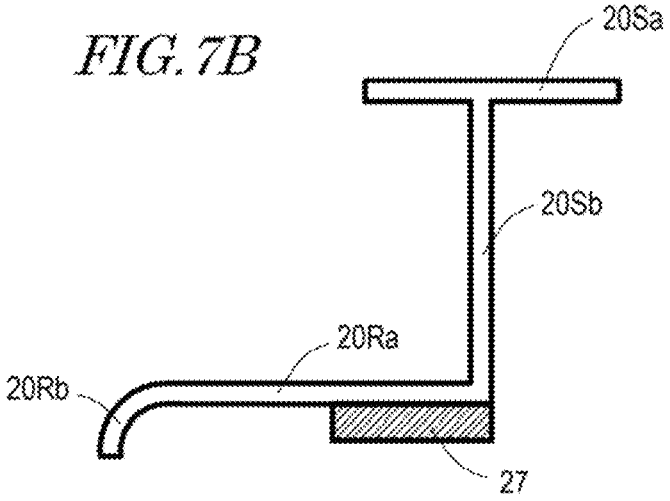
Figure 7C:
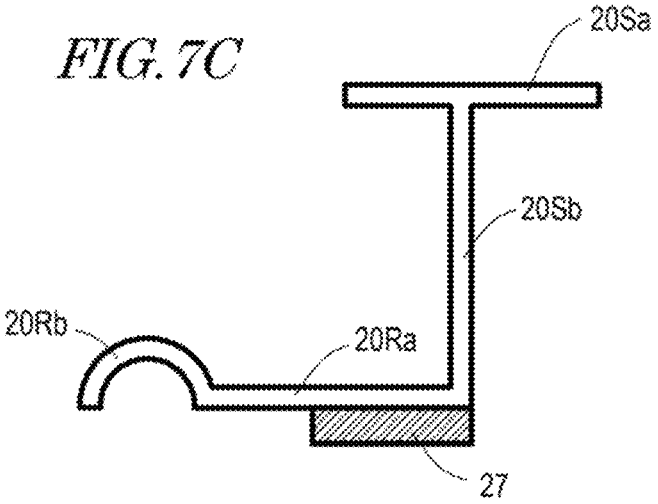
Figure 8A:
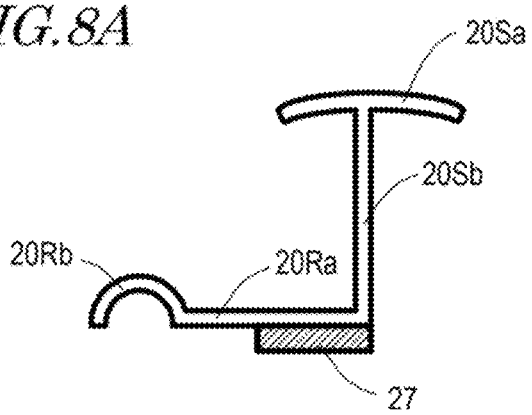
FIG. 8A, FIG. 8B and FIG. 8C are schematic plan views of protection members.
Figure 8B:
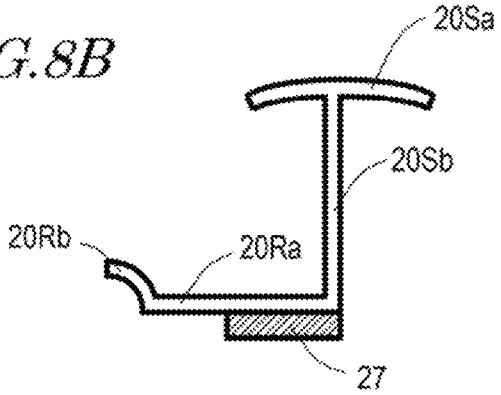
Figure 8C:
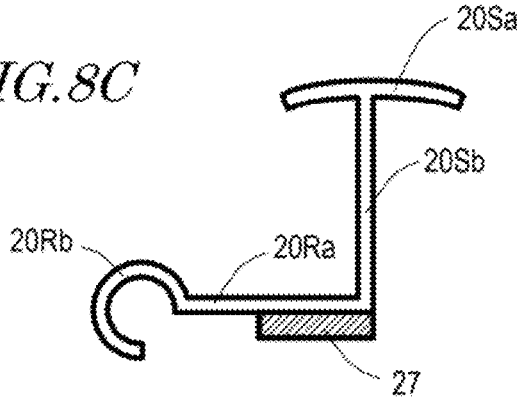
Figure 8D:
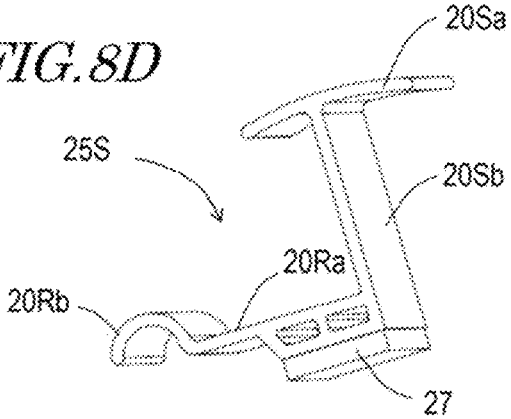
FIG. 8D is a schematic perspective view of a protection member shaving substantially the same structure as that of the protection member shown in FIG. 8A.

FIG. 5A is a schematic perspective view of the protection member as seen from above, and FIG. 5B is a schematic plan view of the protection member. FIG. 6A through FIG. 6D are schematic plan views of protection members. FIG. 7A through FIG. 7C are schematic plan views of protection members. FIG. 8A through FIG. 8C are schematic plan views of protection members, and FIG. 8D is a schematic perspective view of a protection member having substantially the same structure as that of the protection member shown in FIG. 8A.

First, FIG. 5A and FIG. 5B will be referred to.

The protection member 20*a* includes the receiving portion 20R having the receiving surface 24 parallel to the xz plane and the support portion 20S integrally formed with the receiving portion 20R. An optional protection sheet 27 is provided on a contact region, of the receiving surface 24, that is to be in contact with the panel module 200. The protection sheet 27 may be omitted.

The support portion 20S includes a contact portion 20Sa, which is parallel to the xz plane and is located so as to be in contact with a side surface, of the side surface member 14, that is parallel to the xz plane, and also includes a second flat plate portion 20Sb, which crosses the receiving surface 24 and is parallel to the yz plane. A side surface, of the second flat plate portion 20Sb, that is parallel to the yz plane is in contact with the side surface, of the protruding portion 15*a*, that is parallel to the yz plane.

The receiving portion 20R includes a first flat plate portion 20Ra, which has the receiving surface 24 and is parallel to the xz plane, and also includes a securing portion 20Rb rising in the y direction from a tip end of the first flat plate portion 20Ra. In the case where the protection member 20*a* is attached to the protruding portion 15*a* of the accommodation member 10 of the container 100 (see FIG. 4), the tip end of the first flat plate portion 20Ra and the securing portion 20Rb are fit into the second side surface member 14*b*, and a rear surface of the contact region is in contact with a side surface, of the protruding portion 15*a*, that is parallel to the xz plane.

Since the tip end of the first flat plate portion 20Ra and the securing portion 20Rb are fit into the second side surface member 14*b*, the protection member 20*a* secured to the side surface member 14 may withstand a load applied in the y direction. In the case where a side surface of the securing portion 20Rb rising in the y direction from the tip end of the first flat plate portion 20Ra is in contact with the side surface of the protruding portion 15*a*, the securing portion 20Rb holds the protruding portion 15*a* together with the second flat plate portion 20Sb. Therefore, the protection member 20*a* secured to the side surface member 14 may withstand a load applied in the x direction.

In addition, since the rear surface of the contact region is in contact with the protruding portion 15*a*, the load applied to the receiving portion 20R is received by the protruding portion 15*a*. In this manner, the load applied to the protection member 20*a* in the y direction is dispersed to the protruding portion 15*a* (second side surface member 14*d*) as intended.

The receiving portion 20R is integrally formed with the support portion 20S. Therefore, the load applied to the contact portion 20Sa via the second flat plate portion 20Sb is received by the first side surface member 14*a*. In this manner, the load applied to the protection member 20*a* in the y direction is dispersed to the first side surface member 14*a*. It is preferred that the contact portion 20Sa is inserted between the first side surface member 14*a* and the protruding portion 15*a*. This may reinforce the securing state of the protection member 20*a* to the side surface member 14. The contact portion 20Sa may be entirely or partially inserted between the first side surface member 14*a* and the protruding portion 15*a* (see FIG. 6A and FIG. 6B).

In this case, it is preferred that there is no gap between the protection member and the side surface member 14. It may occur that the panel module 200 collides against the container 100 by the vibration during the transportation, and as a result, the corner of the container 100 is cracked. The possibility of such a crack may be decreased by leaving no gap between the protection member and the side surface member 14. In the case where the side surface of the first side surface member 14*a* is in contact with a side surface of the contact portion 20Sa in a cross-section parallel to the xy plane, the load applied to the contact portion 20Sa via the second flat plate portion 20Sb is dispersed to the first side surface member 14*a* as intended. As long as no unnecessary gap is formed between the protection member and the first side surface member 14*a* or between the protection member and the second side surface member 14*d*, the protection member may be located at the corner so as to be detachable in the z direction.

It is preferred that on the protection member having such a structure, the optional protection sheet 27 is provided on the contact region, of the receiving surface 24, that is to be in contact with the panel module 200. The protection sheet 27 is not absolutely necessary (FIG. 6C). A spacer 26 may be provided between the receiving surface 24 and the protection sheet 27 when necessary due to the size of the panel module 200 to be accommodated (FIG. 6D).

It is preferred that an orthogonal projection of the contact region onto the xz plane overlaps an orthogonal projection of the contact portion 20Sa onto the xz plane. It is more preferred that the middle point in the x direction of the orthogonal projection of the receiving portion 20R and the contact portion 20Sa onto the xz plane overlaps the orthogonal projection of the contact region onto the xz plane. Such a structure is preferred in order to prevent the protection member 20 from unnecessarily pivoting. In addition, in the case where the above-mentioned middle point matches the middle point in the x direction of the orthogonal projection of the contact region onto the xz plane, the contact region is located at the center of the protection member in a front view, of the protection member, parallel to the xz plane. Therefore, the load applied in the y direction is dispersed to the side surface member 14 (first side surface member 14*a*) as intended.

As described above, the securing portion 20Rb rises so as to get closer to the contact portion 20Sa from the tip end of the first flat plate portion 20Ra. Therefore, the protruding portion 15*a* is held between the securing portion 20Rb and the side surface, of the second flat plate portion 20Sb, that is in contact with the side surface of the protruding portion 15*a*. Such a structure allows the protection member secured to the side surface member 14 to withstand the load applied in the x direction. It should be noted that the securing portion 20Rb of the protection member may extend so as to be distanced away from the contact portion 20Sa (FIG. 7A through FIG. 7C). The reason for this is that as long as the securing portion 20Rb extends by a y direction component from the tip end of the first flat plate portion 20Ra, the protection member may withstand the load applied in the x direction. As shown in FIG. 7B and FIG. 7C, it is preferred that the securing portion 20Rb has a circular shape or a shape of a part of a circle in the xy plane. In this case, the securing portion 20Rb may extend so as to be gradually distanced away from the contact portion 20Sa (FIG. 7B), or may extend so as to once get closer to, and then to be distanced away from, the contact portion 20Sa (FIG. 7C). Such a shape of the securing portion 20Rb allows the y direction component of the load applied to a tip end of the securing portion 20Rb to be decreased, and therefore, easily avoids the above-mentioned crack.

Regarding the shape of the contact portion 20Sa, it is preferred that as shown in, for example, FIG. 8A through FIG. 8D, the distance in the y direction from the side surface of the contact portion 20Sa to the first flat plate portion 20Ra gradually decreases in a direction toward a tip end of the contact portion 20Sa. It is more preferred that the side surface, of the contact portion 20Sa, that is in contact with the side surface member 14 (first side surface member 14*a*) of the container 100 is arcked in the xy plane. Such a structure allows the load, applied from the receiving surface 24 of the protection member to the side surface member 14 (first side surface member 14*a*) via the contact portion 20Sa, to be dispersed in many directions. As a result, the y direction component of the load acting on a contact point of the contact portion 20Sa and the side surface member 14 (first side surface member 14*a*) may be decreased.

Since the side surface of the contact portion 20Sa is arcked in the xy plane, the contact portion 20Sa is bent easily. As a result, the load applied to the side surface member 14 is decreased. The size and the radius of curvature of the arc may be appropriately set such that the load applied to the contact portion 20Sa from the receiving portion 20Ra acts vertically on the side surface of the side surface member 14 (the first side surface member 14*a*) in the entire region of the side surface of the contact portion 20Sa.

It is preferred that as shown in, for example, FIG. 8A through FIG. 8D, the securing portion 20Rb is circular or arcked in the xy plane. Such a structure allows the load, applied from the receiving surface 24 of the protection member to the securing portion 20Rb via the first flat plate portion 20Ra, to be dispersed in many directions. As a result, the y direction component of the load acting on a contact point of the securing portion 20Rb and the side surface member 14 (second side surface member 14*d*) may be decreased. Specifically, as shown in FIG. 8A through FIG. 8C, the securing portion 20Rb may have, in the xy plane, a shape of a part of a circle having the center located on the first flat plate portion 20Ra or a line extending therefrom, and the central angle thereof is preferably 90 degrees or larger and 270 degrees or smaller. In the case where the securing portion 20Rb has the shape shown in FIG. 8A in the xy plane, the direction of the load applied to the tip end of the securing portion 20Rb is shifted by 180 degrees from the direction of collision. In the case where the securing portion 20Rb has the shape shown in FIG. 8B or FIG. 8C in the xy plane, the direction of the load applied to the tip end of the securing portion 20Rb is shifted by 90 degrees from the direction of collision. Therefore, as compared with the case where the securing portion 20Rb has the shape shown in FIG. 6B, the y direction component at the tip end of the securing portion 20Rb is significantly smaller. Thus, the side surface member 14 may be prevented from being cracked at the tip end of the securing portion 20Rb.

It is preferred that as shown in FIG. 8D, an end surface at the tip end of each of the contact portion 20Sa and the securing portion 20Rb is chamfered in order to prevent the side surface member 14 from being cracked.

Each of the contact portion 20Sa, the second flat plate portion 20Sb and the first flat plate portion 20Ra independently has a thickness of, for example, 2 mm or greater and 3 mm or less.

The contact portion 20Sa, the second flat plate portion 20Sb, the first flat plate portion 20Ra and the securing portion 20Rb have the same height Z1.

The contact portion 20Sa and the second flat plate portion 20Sb of the support portion 20S and the first flat plate portion 20Ra define a generally parallelopiped space 25S. The space 25S may be filled with the protruding portion 15*a* (see, for example, FIG. 4).

The protruding portion 15*a* protruding in the x direction from the second side surface member 14*d* is formed of the same material as that of, and integrally formed with, the accommodation member 10. Since the protruding portion 15*a* itself is integrally formed with the accommodation member 10, the protection member may be suppressed from being deformed and/or moved (rotated).

As described above with reference to FIG. 9, the protection member 90*a* included the container 900 in the comparative example is molded to have a high rigidity. Therefore, the protection member 90*a* is integrally rotated, and as a result, a portion of the protection member 90*a* that has the receiving surface RS1 collides against a side of the panel module 200. As a result, the frequency at which the glass substrate forming the panel is cracked or chipped away is increased.

Now, preferred materials for each of the elements of the container 100 will be described. The materials described below are preferred examples of materials for the container 100 transporting the panel module 200, and the preferred materials are not limited to those described below.

The accommodation member 10 (bottom surface member 12 and side surface member 14) and the protection member 20*a* may all be formed of a plastic material. A plastic material preferably usable for these elements is any of various known plastic materials (thermoplastic resins). Examples of the usable plastic material include polyolefins such as polyethylene, polypropylene and the like, polystyrenes, and mixtures (blends) thereof. These plastic materials in an expanded form are also usable.

For the accommodation member 10, a material having a large effect of absorbing an impact during the transportation is preferred. The accommodation member 10 is preferably formed of an expanded plastic material. For the protection member 20*a*, which directly receives a force from the panel module 200 (panel 202), a material harder than the material of the accommodation member 10 is preferred. The protection member 20*a* is preferably formed of a non-expanded plastic material. The protection sheet is preferably formed of a non-expanded plastic material harder than the material of the protection member 20*a*.

For example, the protection member 20*a* is formed of, preferably, non-expanded polyethylene, and more preferably, high density polyethylene from the point of view of the hardness. The protection member 20*a* may be formed of polycarbonate. The protection sheet 27 is in direct contact with, for example, a glass substrate of the panel module 200 (panel 202) and therefore, is preferably formed of polycarbonate or hard rubber, each of which is highly abrasion resistant.

The accommodation member 10 is preferably formed of expanded polyethylene (EPE), expanded polypropylene (EPP) or expanded polystyrene (EPS, also referred to as "styrofoam"). Among these materials, expanded polystyrene (EPS) is most preferable from the point of view of cost performance. It should be noted that in order to transport the panel module 200 more safely, it is especially preferred to use expanded polystyrene expanded at a ratio lower than that of commonly and widely used expanded polystyrene (expansion ratio: about 70 times), for example, expanded polystyrene expanded at a ratio of about 20 times to about 50 times. The protruding portion 15*a* may be formed of the same material as that of the accommodation member 10 and may be integrally formed with the bottom surface member 12.

The above-described materials have been selected based on results of a vibration test and an impact test. For the vibration test and the impact test, a state in which 11 liquid crystal display panel modules (70-inch type) were accommodated in the container 100 produced with each of various materials was simulated. With the above-described materials, the impact resistance is significantly improved, and therefore, the liquid crystal display panel modules may be transported safely. Namely, the liquid crystal display panel modules may be suppressed from being broken during the transportation. The 70-inch liquid crystal display panel modules used for the tests had a size of about 1550 mm×about 880 mm. The container 100 had an outer shape of about 1700 mm to about 1800 mm×about 1000 mm to about 1100 mm and a height of about 120 mm to about 150 mm. In order to increase the strength, the outer shape of the container 100 may be increased. In order to increase the transportation efficiency and decrease the cost, the outer shape of the container 100 may be decreased. The material of each of the elements may be selected from the above-listed materials, and the size of each of the elements may be optimized, in accordance with the use.

An embodiment of the present invention is directed to a container preferably usable to, for example, transport an object accommodated therein.

While the present invention has been described with respect to exemplary embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

The present application claims priority of Japanese Patent Application No. 2020-035155, filed on Mar. 2, 2020, the entire contents of which are hereby incorporated by reference.

What is claimed is:

1. A container, comprising:

an accommodation member including a bottom surface member defining a bottom surface of an accommodation space having four corners and also including a side surface member defining side surfaces of the accommodation space, the bottom surface member defining an xy plane and the side surface member defining an xz plane and a yz plane both perpendicular to the xy plane; and two protection members located at two corners adjacent to each other among the four corners of the accommodation space, wherein the side surface member includes a first side surface member extending in an x direction and a second side surface member extending in a y direction, and a protruding portion protruding in the x direction from the second side surface member is formed at each of the two corners, wherein each of the two protection members includes a receiving portion having a receiving surface that is in contact with an object to be accommodated in the accommodation space and includes a support portion integrally formed with the receiving portion, wherein the receiving portion includes a first flat plate portion parallel to the xz plane, and the support portion includes a contact portion having a side surface that is in contact with a side surface, of the first side surface member, that is directed toward the accommodation space and includes a second flat plate portion coupling the first flat plate portion and the contact portion to each other, the second flat plate portion being parallel to the yz plane, and wherein a tip end of the first flat plate portion is fit into the second side surface member, and a rear surface of a contact region, of the receiving surface, that is to be in contact with the object is in contact with a side surface, of the protruding portion, that is parallel to the xz plane.

2. The container of claim 1, wherein the contact portion is entirely or partially inserted between the first side surface member and the protruding portion.

3. The container of claim 1, wherein an orthogonal projection of the contact region onto the xz plane overlaps an orthogonal projection of the contact portion onto the xz plane.

4. The container of claim 3, wherein a middle point in the x direction of the orthogonal projection of the receiving portion and the contact portion onto the xz plane overlaps the orthogonal projection of the contact region onto the xz plane.

5. The container of claim 4, wherein the middle point in the x direction of the orthogonal projection of the receiving portion and the contact portion onto the xz plane matches a middle point in the x direction of the orthogonal projection of the contact region onto the xz plane.

6. The container of claim 1, wherein the receiving portion further includes a securing portion extending by a y direction component from the tip end of the first flat plate portion.

7. The container of claim 6, wherein a side surface, of the second flat plate portion, that is parallel to the yz plane is in contact with a side surface, of the protruding portion, that is parallel to the yz plane.

8. The container of claim 6, wherein the securing portion has a circular shape or a shape of a part of a circle in the xy plane.

9. The container of claim 1, wherein a distance in the y direction from the side surface of the contact portion to the first flat plate portion gradually decreases in a direction toward a tip end of the contact portion.

10. The container of claim 9, wherein the side surface of the contact portion is arcked in the xy plane.

11. The container of claim 1, wherein the accommodation member is formed of an expanded plastic material.

12. The container of claim 1, wherein the protection member is formed of a non-expanded plastic material.

13. The container of claim 1, further comprising a protection sheet provided on the receiving surface of the protection member, wherein the protection sheet is formed of a non-expanded plastic material harder than the material of the protection member.

* * * * *